US007049274B2

(12) United States Patent
Ranade et al.

(10) Patent No.: US 7,049,274 B2
(45) Date of Patent: May 23, 2006

(54) PROCESS FOR PREPARING PERFUME FILM CHIPS

(75) Inventors: Vidyadhar Sudhir Ranade, Vlaardingen (NL); Antonius Henricus Strijbosch, deceased, late of Vlaardingen (NL)

(73) Assignee: Unilever Home & Personal Care USA, a division of Conopco, Inc., ., CT (US)

( * ) Notice: Subject to any disclaimer, the term of this patent is extended or adjusted under 35 U.S.C. 154(b) by 195 days.

(21) Appl. No.: 10/648,629

(22) Filed: Aug. 27, 2003

(65) Prior Publication Data

US 2005/0079991 A1 Apr. 14, 2005

(30) Foreign Application Priority Data

Aug. 27, 2002 (EP) ..... 02078527

(51) Int. Cl.
*C11D 11/00* (2006.01)

(52) U.S. Cl. ..... 510/101; 510/445; 510/513; 264/118; 264/145

(58) Field of Classification Search ..... 510/101, 510/445, 276, 405, 513; 264/118, 145
See application file for complete search history.

(56) References Cited

U.S. PATENT DOCUMENTS

| | | | | |
|---|---|---|---|---|
| 3,966,902 | A * | 6/1976 | Chromecek | 424/59 |
| 4,152,272 | A | 5/1979 | Young | |
| 4,209,417 | A | 6/1980 | Whyte | |
| 4,339,356 | A * | 7/1982 | Whyte | 512/4 |
| 4,402,856 | A | 9/1983 | Schnoring et al. | |
| 5,066,419 | A | 11/1991 | Walley et al. | |
| 5,094,761 | A | 3/1992 | Trinh et al. | |
| 5,858,959 | A | 1/1999 | Surutzidis et al. | |

FOREIGN PATENT DOCUMENTS

| | | |
|---|---|---|
| EP | 0 469 228 B1 | 2/1992 |
| EP | 0 879 874 A3 | 11/1998 |
| GB | 2 090 278 A | 7/1982 |
| WO | 96/21719 | 7/1996 |
| WO | 97/11151 | 3/1997 |
| WO | 98/12298 | 3/1998 |
| WO | 98/42818 | 10/1998 |
| WO | WO 2004/006967 A1 * | 1/2004 |
| WO | WO 2005/123892 A1 * | 12/2005 |

OTHER PUBLICATIONS

RD 167063 (Research Disclosure) dated Feb. 20, 1978 (see abstract).*

* cited by examiner

*Primary Examiner*—Lorna M. Douyon
(74) *Attorney, Agent, or Firm*—Alan A. Bornstein

(57) ABSTRACT

A process for preparing perfume film chips comprising inclusions of perfume particles.

12 Claims, No Drawings

PROCESS FOR PREPARING PERFUME FILM CHIPS

FIELD OF THE INVENTION

The present invention relates to the delivery of perfume particles in applications such as for cleaning and treating laundry, kitchen, skin or hair surfaces. In particular, a process is provided for the preparation of perfume film chips comprising inclusions of perfume particles, said perfume film chips, cleaning compositions comprising said perfume film chips, a method of improving the storage stability of perfume particles and a method for depositing perfume onto a surface.

BACKGROUND OF THE INVENTION

Most consumers have come to expect scented laundry products and to expect that fabrics which have been laundered also have a pleasing fragrance. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. Industry, therefore, has long searched for an effective perfume delivery system for use in detergent products which provides long-lasting, storage-stable fragrance to the product, as well as releases fragrance during use to mask wet solution odor and delivers fragrance to the laundered fabrics.

It is known that deposition of fragrance on to surfaces to be cleaned can be greatly enhanced by using fragrance particles. These particles also cue cleanliness for a longer time because they slowly release perfume after cleaning (EP-A-469228). Such particles are made either by supporting the fragrance on a porous carrier or by encapsulating the fragrance in a shell. To some extent the storage stability of fragrances is also improved by using fragrance particles (e.g. WO9621719, U.S. Pat. No. 5,858,959 and WO9711152). Further improvements have been reported by coating such particles (e.g., GB2090278, EP-A-0879874). Nevertheless, in practice the use of such particles have never been satisfactory.

There has been a continuing search for methods and compositions which will effectively and efficiently deliver perfume from a laundry bath onto fabric surfaces. As can be seen from the following disclosures, various methods of perfume delivery have been developed involving protection of the perfume through the wash cycle, with release of the perfume onto fabrics. U.S. Pat. No. 4,402,856, Schnoring et al, issued Sep. 6, 1983, teaches a microencapsulation technique which involves the formulation of a shell material which will allow for diffusion of perfume out of the capsule only at certain temperatures. U.S. Pat. No. 4,152,272, Young, issued May 1, 1979, teaches incorporating perfume into waxy particles to protect the perfume through storage in dry compositions and through the laundry process. The perfume assertedly diffuses through the wax on the fabric in the dryer. U.S. Pat. No. 5,066,419, Walley et al, issued Nov. 19, 1991, teaches perfume dispersed with a water-insoluble nonpolymeric carrier material and encapsulated in a protective shell by coating with a water-insoluble friable coating material. U.S. Pat. No. 5,094,761, Trinh et al, issued Mar. 10, 1992, teaches a perfume/cyclodextrin complex protected by clay which provides perfume benefits to at least partially wetted fabrics.

U.S. Pat. No. 4,209,417 describes how a mixture of polyvinyl alcohol and perfume mixtures is cast into a film. This film does not contain perfume particles as such.

However, even with the substantial work done by industry in this area, a need still exists for a simple, more efficient and effective perfume delivery system which can be used in laundry compositions to provide initial and lasting perfume benefits to fabrics which have been treated with the laundry product. The prior art methods usually rely on complicated process steps of multiple layers or coating of the perfume particle to function as a barrier thereby increasing the cost and complexity of the supply chain. Even then storage stability of the perfume particles is often unsatisfactory. The process whereby granulates are extruded in often difficult to control when particles of the appropriate size and solubility are desired. Another problem that may occur in providing perfumed products is the excessive odor intensity associated with the products. The industry is still searching for improvements in the length of storage time of the laundry compositions without loss of perfume characteristics, in the intensity or amount of fragrance released during the wash process and delivered to fabrics, and in the duration of the perfume scent on the treated fabric surfaces. A need therefore exists for a process to protect perfume particles which overcomes one or more of the above mentioned drawbacks.

By the present invention it has now been discovered that perfume loaded in and/or on to carriers can be effectively protected from premature release of perfume by forming a film of water-reactive material containing inclusions of perfume particles and preparing perfume chips from said film. The carrier may be porous and may be selected to be substantive to fabrics to be able to deposit enough perfume on the fabrics to deliver a noticeable odor benefit even after the fabrics are dry.

The present invention solves the long-standing need for a simple, flexible, cost-effective, storage-stable perfume delivery system which provides consumer—noticeable odor benefits during and after the laundering process, and which has reduced product odor during storage of the composition.

SUMMARY OF THE INVENTION

The present invention relates to a process for the preparation of perfume film chips comprising inclusions of perfume particles, which may be incorporated in a variety of consumer products, including cleaning/care compositions for variety of surfaces (laundry, kitchen, dishes, skin, hair), room deodorizers, insecticidal compositions, carpet cleaners and deodorizers wherein the perfume is protected from release until exposed to a wet or moist environment. The present invention can be used to deliver perfume agents in the wash cycle or rinse cycle.

In traditional perfume delivery systems most of the perfume material is "lost" due to diffusion of the volatile perfume materials from the product during storage and is not delivered to the fabric surface. In the present invention, the perfume film chips effectively entraps the perfume material loaded into or onto the particle carrier. Thus, the perfume material is delivered to the fabric surface at a higher amount through the wash than with traditional perfume delivery systems.

In addition, the protective film chip enables the perfume to withstand the relatively harsh environment of other cleaning agents. The perfume film chips can be made of any size so as to tailor it to the desired application and dose level. The perfume film chips maybe of such size that they can be added to detergent compositions such as granular compositions or suspended in liquid compositions. Another advantage of perfume film chips is that it may provide a cost effective and simple way of matching the density of the perfume film chips to the density of the cleaning composition. In addition, the inventive process provides a more controllable and flexible process to provide a readily soluble perfume film chip of the appropriate size, compared to extruded granulates of a similar size. Although not wishing to be bound by theory, it is believed that the high pressures necessary to extrudate granulates of sufficiently small size increases the density of the granulates leading to solubility problems.

Accordingly, one embodiment of the present invention to provides a process for preparing perfume film chips comprising inclusions of perfume particles wherein said particles comprise particle carrier material and perfume and said process comprises the steps of a) forming a film of water reactive material containing inclusions of perfume particles;
b) solidifying said film by cooling and/or drying and
c) comminuting the solidified film into perfume film chips comprising inclusions of perfume particles. Another embodiment of the present invention provides a method for depositing perfume onto a surface, preferably a fabric surface.

These and other aspects, embodiment, features and advantages will become apparent to those of ordinary skill in the art from a reading of the following detailed description and the appended claims. It is noted that the examples given in the description below are intended to clarify the invention and are not intended to limit the invention to those examples per se. Other than in the experimental examples, or where otherwise indicated, all numbers expressing quantities of ingredients or reaction conditions used herein are to be understood as modified in all instances by the term "about". Similarly, all percentages are weight/weight percentages of the total composition unless otherwise indicated. Where the term "comprising" is used in the specification or claims, it is not intended to exclude any terms, steps or features not specifically recited. All temperatures are in degrees Celsius (° C.) unless otherwise specified. All measurements are in SI units unless otherwise specified. All documents cited are in relevant part, incorporated herein by reference.

DETAILED DESCRIPTION OF THE PREFERRED EMBODIMENTS

One of aspect of the present invention relates to process for the preparation of a perfume film chip comprising inclusions of perfume particles wherein said particles comprise particle carrier material and perfume whereby said process comprises the steps of a) forming a film of water reactive material containing inclusions of perfume particles; b) solidifying said film by cooling and/or drying and c) comminuting the solidified film into perfume film chips comprising inclusions of perfume particles. The perfume film chip is particularly useful in combination with laundry and cleaning compositions including traditional granular and liquid laundry detergents as well as granular and liquid bleach, automatic dishwashing, kitchen surface cleaning, fabric softening compositions and personal care compositions. Liquid detergents is meant to include gel, paste like product formats. The perfume film chip comprising inclusions of perfume particles of the present invention provides superior through the wash perfume delivery capabilities and/or as minimizes intense product odor due to evolving volatile perfume ingredients. The inventive perfume delivery is also cost effective, simple and efficient compared to the prior art coating and encapsulation techniques.

Process for the Preparation of Perfume Film Chips

According to one aspect of the invention a process is provided for improving the storage stability of perfume particles comprising the steps of a) forming a film of water reactive material containing inclusions of perfume particles; b) solidifying said film by cooling and/or drying and c) comminuting the solidified film into perfume film chips comprising inclusions of perfume particles. The formation of a film comprising water reactive material and inclusions of perfume particles can be obtained in several ways known in the art. According to one preferred aspect the formation comprises admixing water reactive material and perfume particles. This may involve admixing perfume particles and water reactive material in a mixer. The mixture of perfume-particles and the water reactive material may be heated to a molten state. Alternatively an aqueous solution of water reactive material could be used in the process. Usually sufficient water is admixed to provide for a sufficient viscosity so that the mixture can be formed into a film. The film is preferably formed by casting, solvent casting or extrusion of said mixture, or other means as known in the art. Preferably, the process for forming the film is a non-extrusion process. One particularly preferred method is casting and in particular aqueous casting on a rotating drum or a moving belt. This method provides the opportunity to include air or another gas into said mixture to increase the body of the perfume film chip, a simple and cost effective way to match the perfume film chip density to density of the cleaning composition. Preferably, the perfume film chip comprises, in addition to the inclusions of perfume particles, more than 5% (vol/vol) of gas-inclusions by volume of the perfume film chip whereby the gas is selected from the group comprising air, nitrogen, oxygen, argon and helium and mixtures thereof. Preferably the gas is air and/or nitrogen. Preferably, the perfume film chip comprises, in addition to the inclusions of perfume particles, more than 10 vol % and preferably less than 90 vol %, more preferably less than 50 vol % of gas-inclusions by volume of the perfume film chip. In a next step the freshly cast film containing inclusions of perfume particles is solidified by cooling and/or drying. The freshly cast film may be cooled due to exposure to ambient conditions and/or a cold surface. In addition or alternatively, the freshly cast film could be dried for example by blowing hot air over it or heating the surface on which it is cast. Preferably, the film containing inclusions of perfume particles is solidified to an average film thickness of less than 4 mm, preferably less than 3 mm, more preferably less than 2 mm, most preferably less than 1 mm thick. It is understood that for the purpose of this invention the thickness of the film refers to the average thickness of the solidified film containing inclusions of perfume particles. The inclusions may comprise one or more perfume particles per inclusion. Particularly useful embodiments are provided when the D(4,3) volume weighted mean diameter of the inclusions is less than the average film thickness, more preferably less than 75%, even more preferably less than 50%, still more preferably less than 35% of the average film thickness. For the purpose of the present invention, the size or diameter of perfume film chip, inclusions, perfume particles is meant to refer to 'volume weighted mean diameter' denoted by D[4, 3] as described by M. Alderliesten in Part. Part. Syst. Charact., 7 (1990), 233–241. This is preferably determined by a Malvern Mastersizer X particle analyser. Another preferred device is the X-ray Tomograph equipment known as Skyscan™ 1072. One preferred method involves calculating the average diameter of inclusions from an image of virtual slice of perfume chips taken with the Skyscan™ 1072 along 16 or 32 axes in the image plane. The most preferred method to calculate the average size of inclusions uses a grid of suitable fineness comprising horizontal and vertical lines. This grid is superposed on the image of a virtual slice. The distances over which the grid lines superpose on a single inclusion are averaged to get the size of that inclusion. This process is repeated for all inclusions in a virtual slice. Measurements are made through several slices, the spacing between two adjacent slices being at least equal to the smallest dimension of a perfume chip. The average diameter distribution (number frequency versus diameter) is then compiled, and the D(4,3) volume weighted mean average diameter is calculated from this distribution.

The solidified film is then comminuted into perfume film chips comprising inclusions of perfume particles. The step of comminuting the film into perfume film chips may be done in several ways know in the art including grinding which can be completed in any know grinding apparatus such as a hammer mill or a ball mill. The resulting perfume film chips preferably have a D(4,3) volume weighted mean diameter in a range from about 100 to about 4000 microns. When the perfume film chips are used in granular compositions the size of the perfume film chips is preferably 150 microns to about 1100 microns, more preferably from about 200 microns to about 800 microns, and more preferably from about 400 microns to about 600 microns. When the perfume film chips are used in liquid compositions, the size of the perfume film chips may be 1200 to 3500 micron, preferably 1500 to 3000 micron. However, it is preferred that the smallest dimension of the perfume film chip after comminution is equal to the average film thickness. The perfume film chips may also be screened after grinding to provide perfume film chips of the desired size.

Optionally, the process further comprises the step of screening or separating the perfume film chips into undersized or "fines" and oversized or "overs" perfume film chips, wherein the undersized film chips have size of less than about 100 microns and the oversized perfume film chips 30 have size of at least 1100 microns. In another preferred embodiment, in particular when the film has a brittleness value of less than 100% or 50% as defined hereinafter, the film cracks up after solidification—e.g. on the drum or belt—into small chips which are scraped off or blown from the drum or belt. The chips might be comminuted further using standard techniques to give particles of the right size and shape. Also the perfume particles themselves may comprise a coloured substance. When an aqueous solution of water reactive material is used in the process, the film is preferably cast on a drum or a belt and solidified by drying for example by using hot air and/or gas. As the water evaporates, the Tg of the mixture increases and a solid film is obtained on the drum or the belt. Comminuting the film may be achieved by simply scraping it off to give perfume film chips comprising inclusions of perfume particles.

Some perfume particles are usually made in a slurry or paste form (e.g. swellable or encapsulation particle carrier material such as aminoplast particles). The inventive process is particularly convenient for protecting such perfume particles by incorporating these into the perfume film chips according to the present invention. This obviates the need to pre-dry the slurry or paste. In some cases, the particle carrier material itself or any optional coating may provide a first barrier to prevent premature perfume loss. In those cases when the perfume film chips may provide an additional barrier, the perfume particles may also be at least partly embedded in a freshly cast film when it is still soft, for example by spraying or printing. Thus according to another embodiment a method of improving the storage stability of perfume particles is provided comprising the steps of a) forming a film of water reactive material containing inclusions of perfume particles;
b) solidifying said film by cooling and/or drying and
c) comminuting the solidified film into perfume film chips comprising inclusions of perfume particles.

According to another aspect of the invention particularly useful perfume film chips comprising inclusions of perfume particles are provided whereby the D(4,3) volume weighted mean diameter of the inclusions is less than the D(4,3) volume weighted mean diameter of the perfume film chip, more preferably less than 75%, even more preferably less than 50, still more preferably less than 35% of the D(4,3) volume weighted mean diameter of the perfume film chip.

Optionally, the perfume film chip may comprise 0 to 70 wt. %, more preferably 0.001 to 10 wt. % of a dye or a pigment by weight of the final film chip composition.

Water-Reactive Material

The perfume film chips are made from a water-reactive material. For the purpose of the invention, water-reactive material means material which either dissolves, ruptures, disperses or disintegrates (or mixtures thereof) upon contact with water, releasing thereby the perfume particles. Preferably, the material is water-soluble.

The perfume film chips of the present invention typically comprise from about 1 wt. % to about 95 wt. % of the water reactive material, preferably from about 10 wt. % to about 90 wt. %, and more preferably from about 20 wt. % to about 75 wt. % by weight of the total perfume chip composition.

In one preferred embodiment, the water reactive material is such that the film comprising the perfume particles releases its content during the rinse cycle. This is possible by incorporating a trigger into the water reactive material known in the art such as described in U.S. Pat. No. 4,765,916.

The perfume film chips are preferably made from a water-soluble film, said water-soluble film having a solubility in water of at least 50%, preferably at least 75% or even at least 95%, as measured by the gravimetric method set out hereinafter using a glass-filter with a maximum pore size of 50 microns.

Gravimetric method for determining water-solubility of water reactive material

The water-solubility of water-reactive material—excluding perfume particle inclusions—may be tested with the following procedure at 25° C. One gram±0.01 gram of chips made form water-reactive material without perfume particle inclusions is added in a 400 ml beaker, whereof the weight has been determined, and 400 ml±1 ml of distilled water is added. This is stirred vigorously on magnetic stirrer set at 300 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining material is determined (which is the dissolved or dispersed fraction). Then, the % solubility or dispersability can be calculated. The longest dimension of the material is 4 mm. When this test is used to determine the water solubility of film material, the material is tested after the film is formed. Likewise, when water soluble particle carrier material is tested, preferably the material is tested after the formation of particles.

The film is preferably self-supportive. The firmness of the film may be adjusted in various ways. For example by the amount of solids that may include non-functional particles besides the perfume particles. Gas/air bubbles may also be included in the film for the same reason as mentioned above.

Preferred materials are films of polymeric materials, e.g. polymers or co-polymers which are formed into a film or sheet. For the purpose of this invention co-polymers include polymers made from 2 or more co-monomers. Preferred polymers, copolymers or derivatives thereof are selected from polyvinyl alcohols, polyvinyl pyrrolidone, polyalkylene oxides, cellulose, cellulose ethers, polyvinyl acetates and acetals, polycarboxylic acids and salts, proteins, polyamides, polyacrylates, polymethacrylates, polysaccharides, resins, gums such as xanthum and carrageen and mixtures thereof. More preferably the polymers, copolymers or derivatives thereof are selected from polyvinyl alcohols, polyvinyl pyrrolidone, polyalkylene oxides, cellulose ethers, polyacrylates and water-soluble acrylate copolymers, methylcellulose, carboxymethylcellulose sodium, ethylcellulose, hydroxyethyl cellulose, hydroxypropyl methylcellulose, polymethacrylates, gelatin, most preferably polyvinyl alcohols, polyvinyl alcohol copolymers and hydroxypropyl methyl cellulose (HPMC) and mixtures thereof. The polymer can have any weight average molecular weight, preferably from about 1000 to 1,000,000, or even form 10,000 to 300,000 or even form 15,000 to 200,000 or even form 20,000 to 150,000. Preferred polyvinyl alcohols have weight average molecular weight of 2,000 to 30,000.

Mixtures of polymers can also be used. This may in particular be beneficial to control the mechanical and/or dissolution properties of the film, depending on the application thereof and the required needs. For example, it may be preferred that one polymer material has a higher water-solubility than another polymer material, and/or one polymer material has a higher mechanical strength than another polymer material. It may be preferred that a mixture of polymers is used, having different weight average molecular weights, for example a mixture of polyvinyl alcohol (PVA) or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising a hydrolytically degradable and water-soluble polymer blend such as polylactide and polyvinyl alcohol, achieved by the mixing of polylactide and polyvinyl alcohol, typically comprising 1–35 wt. % by weight polylactide and approximately from 65 wt. % to 99 wt. % by weight polyvinyl alcohol, if the material is to be water-soluble.

It may be preferred that the polymer present in the film is from 60% to 98% hydrolysed, preferably 80% to 90%, to improve the dissolution of the material, and/or that the levels of plasticiser, including water, in the film are varied such that the dissolution is adjusted as required.

Preferably, the level of polymer in the film, for example a PVA polymer, is at least 30 wt. % by weight of the film material, i.e., the film as such excluding the perfume particles and any other optional solids and detergent active material. Preferably, the PVA polymer has similar properties to the PVA used in the film known under the trade reference M8630 (Monosol of Portage, Ind., US or "Solublon™ PT30" and "Solublon™ KA40" (Aicello Chemical Co., Ltd., Aichi, Japan). Other highly preferred PVA's are known as Mowiol™ (ex Clariant), Elvanol™ (ex Du Pont) and Celvol™ (ex Celanese).

Another preferred water soluble material includes carbohydrate material derived from one or more at least partially water-soluble hydroxylic compounds, wherein at least one of said hydroxylic compounds has an anhydrous, nonplasticized, glass transition temperature, Tg, of about 0° C. or higher, most preferably from about 40° C. to about 200° C. Further, the carbohydrate material has a hygroscopicity value of less than about 80%. These perfume delivery compositions are especially useful in granular detergent compositions, particularly to deliver laundry and cleaning agents useful at low levels in the compositions. The water soluble materials useful herein are preferably selected from the following. 1. Carbohydrates, which can be any or mixture of: i) Simple sugars (or monosaccharides); ii) Oligosaccharides (defined as carbohydrate chains consisting of 2 to 34 monosaccharide molecules); iii) Polysaccharides (defined as carbohydrate chains consisting of at least 35 monosaccharide molecules). And iv) Starches. Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds. In addition, the following classes of materials may be used as an adjunct with the carbohydrate or as a substitute. 2. All natural or synthetic gums such as alginate esters, carrageenan, agar—agar, pectic acid. and natural gums such as gum Arabic, gum tragacanth and gum karaya. 3. Chitin and chitosan. 4. Cellulose and cellulose derivatives. Examples include: i) Cellulose acetate and Cellulose acetate phthalate (CAP); ii) Hydroxypropyl Methyl Cellulose (HPMC); iii) Carboxymethyl cellulose (CMC); iv) all enteric/aquateric coatings and mixtures thereof. 5. Silicates, Phosphates and Borates. 6. Polyvinyl alcohol (PVA). 7. Polyethylene glycol (PEG). 8. Nonionic surfactants including but not limited to polyhydroxy fatty acid amides. Materials within these classes which are not at least partially water soluble and which have glass transition temperatures, Tg, below the lower limit herein of about 0° C. are useful herein only when mixed in such amounts with the hydroxylic compounds useful herein having the required higher Tg such that the particles produced has the required hygroscopicity value of less than about 80%. Glass transition temperature, commonly abbreviated "Tg", is a well known and readily determined property for glassy materials. This transition is described as being equivalent to the liquification, upon heating through the Tg region, of a material in the glassy state to one in the liquid state. It is not a phase transition such as melting, vaporisation, or sublimation. See William P. Brennan, "'What is a Tg?' A review of the scanning calorimetry of the glasstransition", Thermal Analysis Application Study 47, Perkin-Elmer Corporation, March 1973 for further details. Measurement of Tg is readily obtained by using a Differential Scanning Calorimeter. For purposes of the present invention, the Tg of the hydroxylic compounds is obtained for the anhydrous compound not containing any plasticiser (which will impact the measured Tg value of the hydroxylic compound). Glass transition temperature is also described in detail in P. Peyser, "Glass Transition Temperatures of Polymers", Polymer Handbook, Third Edition, J. Brandrup and E. H. Immergut (Wlley-Interscience; 1989), pp, VI/209–VI/277. At least one of the hydroxylic compounds useful in the present invention must have an anhydrous, nonplasticized Tg of at least 0° C., and for perfume particles not having a moisture barrier coating, at least about 20° C., preferably at least about 40° C., more preferably at least 60° C., and most preferably at least about 100° C. It is also preferred that these compounds be low temperature processable, preferably within the range of from about 40° C. to about 200° C., and more preferably within the range of from about 60° C. to about 160° C. Preferred such hydroxylic compounds include sucrose, glucose, lactose, and maltodextrin.

The film material herein may comprise other additive ingredients such as plasticisers (for example water glycerol, ethylene glycol, diethyleneglycol, propylene glycol, sorbitol and mixtures thereof), stabilisers, disintegrating aids, etc. If one or more of the compositions in the second unit dose is a cleaning composition, then the film material itself may comprise a cleaning agent useful for cleaning compositions, to be delivered to the wash water, for example organic polymeric soil release agents, dispersants, dye transfer inhibitors.

Preferably, the film comprising inclusions of perfume particles has a brittleness degree of less than 100%, preferably less than 50% as measured at the comminuting conditions such as the temperature and humidity. More preferably, the brittleness degree is less than 20% most preferably less than 10%, as determined by comparison of the original length of a piece of film having an average thickness of 1 mm just prior to rupture due to stretching, when a force of from about 1 to about 35 Newtons is applied to a piece of film with a width of 1 cm at a rate of 1 cm/min, preferably 5 cm/min. For example, a piece of film with a length of 10 cm and a width of 1 cm and a thickness of 1 mm is stretched lengthwise with an increasing stress, up to the point that it ruptures. When the film is water sensitive, the film is preferably equilibrated to standard relative humidity e.g., 50% and 20° C. The extent of elongation just before rupture can be determined by continuously measuring the length and the degree of stretching can be calculated. For example, a piece of film with an original length of 10 cm which is stretched with a force of 9.2 Newton to 13 cm just before breaking, has a brittleness degree of 30%. The desired brittleness degree can be obtained by many ways known in the art such as, increasing the drying time of the film, decreasing the amount of plasticiser if any is used and/or decreasing the comminuting temperature (for example by adding dry ice or liquid nitrogen).

When the perfume film chips comprising the perfume particles are enclosed in a pouch, the pouch will react in water to release its contents before the perfume film chips, due to the nature of this construction. To further enhance this sequential release, the pouch may be more water-soluble than the inventive perfume film chips. This can for example be achieved by using different type of material for the pouch than for the film, for example, the pouch is made of a material having a different type of polymer, different plasticiser, different levels components in the material, different coating of the film material, different thickness of the film material.

Perfume Particle

The perfume particle comprises particle carrier material and perfume. The particle carrier material may be selected from encapsulation, swellable or porous carrier material or mixtures thereof. For the present purpose, the terms carrier and core are used interchangeably. Preferably, the particle carrier material and the water reactive material are different. For example, in one preferred embodiment the water reactive material is more water soluble than the particle carrier material. Preferably, the particle carrier material has a water solubility of at most 30%, more preferable at most 20%, most preferably at most 10% as defined by the gravimetric test described below. The low water solubility is thought to prevent the perfume from leaking into the wash liquor.

The particle carrier material, as used herein, means any material capable of supporting (e.g., by absorption or adsorption into and/or onto the pores/surfaces) holding or encapsulating a perfume. Such materials include inorganic porous solids such as zeolites and silica and organic swellable polymers or encapsulation materials such as those based on a polymer. A perfume film chip according to the invention may comprise perfume particles of different particle carrier materials.

The particle carrier material is typically selected from silicas, zeolites, macroporous zeolites, amorphous silicates, crystalline nonlayer silicates, layer silicates, calcium carbonates, calcium/sodium carbonate double salts, sodium carbonates, clays, sodalites, alkali metal phosphates, pectin, chitin microbeads, carboxyalkylcelluloses, gums, resins, gelatin, gum arabic, porous starches, modified starches, carboxyalkyl starches, cyclodextrins, maltodextrins, synthetic polymers such as polyvinyl pyrrolidone (PVP), polyvinyl alcohol (PVA), cellulose ethers, polystyrene, polyacrylates, polymethacrylates, polyolefins, aminoplast polymers, crosslinkers and mixtures thereof. For the purpose of this invention polymers include co-polymers made from 2 or more different co-monomers.

Swellable Carrier Material

According to one preferred embodiment, the perfume particles in the perfume film chip comprise swellable carrier material. The swellable carrier material is typically, and preferably, non-porous and is suitably an organic polymer.

According to one preferred embodiment, the organic polymer produced by polymerisation results in a solid core, rather than a hollow capsule. Advantageously, formation of a solid core enables access to the desired size range of particles, and the polymerisation reaction may be carried out in the absence of perfume.

Suitable organic polymers useful herein are polymers of a vinyl monomer which may be cross-linked or partially cross-linked. It is also possible to use simple linear polymers, however, these can give cores which may lack structural integrity so may dissolve when added to a perfume, or at least be somewhat sticky. Thus, it is usually convenient and preferred to introduce some cross-linking or chain branching.

Therefore, suitable organic polymers useful herein may be formed by polymerisation of vinyl monomers, with some cross-linking and/or chain branching agent included in the monomers which are polymerised, so that some cross-links are formed between the polymer chains. If a cross-linking agent is used, the proportion of cross-linking may be low, so that after polymerisation there may be some polymer chains which remain entirely linear and are not cross-linked to any other chains.

A number of vinyl monomers containing a single carbon-carbon double bond may be used. One suitable category of monomers (A) are esters of acrylic and alkyl acrylic acids of formula:

$H_2C{\sim}CR^1CO_2R^2$ where $R^1$ is hydrogen or straight or branched alkyl of 1 to 6 carbon atoms, preferably 1 to 3 carbon atoms and $R^2$ is straight or branched alkyl of I to 8 carbon atoms, preferably 3 to 6 and most preferably 3 or 4 carbon atoms in a straight or branched chain.

These monomers may be used either singly, or in the form of a combination of two or more monomers. Specific examples of suitable monomers are isobutyl methacrylate (which is particularly preferred), n-butyl acrylate, n-butyl methacrylate, isobutyl acrylate, n-propyl acrylate and isopropylmethacrylate. Less preferred is methyl methacrylate. Another suitable monomer is styrene.

Cross-linking between polymer chains formed from the above monomers can be achieved by including in the monomer mixture a small proportion—for example less than 10%, preferably as little as 5% or 1%—of a monomer having at least two carbon-carbon double bonds. The use of such a material to provide cross-linking is well known in other applications of polymers, although it is usual to introduce a greater proportion of crosslinking than is required for this invention. Examples of this type of cross-linking agent are divinyl benzene, diesters formed between acrylic acid and diols, such as 1,4-butane diol diacrylate, and higher esters formed between acrylic acid and polyols—which may be sugars. Chain branching can be introduced by including among the monomers a hydroxyalkyl monomer of formula:

$H_2C{\sim}CR^1CO_2R^3$ where $R^1$ is as specified above and $R^3$ is alkyl of I to 6 carbon atoms bearing at least one hydroxy group, preferably 3 to 4 carbon atoms in a straight or branched chain and bearing a single hydroxy group. These monomers undergo a side reaction during the course of polymerisation, and this side reaction produces chain branching. When there is chain branching without cross-linking, it is suitable that a hydroxyalkyl monomer of the above formula provides from 10 to 40% by weight of the monomer mixture.

Suitable hydroxyalkyl monomers are hydroxypropyl methacrylate, hydroxybutylacrylate, and hydroxyethylacrylate.

A further suitable category of monomers (B) are esters of acrylic or methacrylic acids of formula:

$H_2C{\sim}CR^4CO_2R^5$ where $R^4$ is hydrogen or methyl and $R^5$ is a straight or branched alkyl of 9 to 16 carbon atoms.

These monomers may be used either singly, or in the form of a combination of two or more monomers.

Specific examples of suitable monomers of the aforementioned category include decyl (meth)acrylates, dodecyl (meth)acrylates, tetradecyl (meth)acrylates, and hexa-decyl (meth)acrylates.

The above-described monomers of category (B) may be combined with one or more further monomers which possess a polymerising unsaturated group, provided that the monomers of category (B) account for the main moiety and are present in not less than 50% by weight of the monomer mixture.

The further monomers which are effectively usable in combination with the monomers of category (B) include (meth)acrylates of monovalent aliphatic alcohols of not more than 9 carbon atoms such as methyl (meth)acrylates, ethyl (meth)acrylates, butyl (meth)acrylates, 2-ethylhexyl (meth)acrylates, and n-octyl (meth)acrylates; (meth)acrylates of monovalent aliphatic alcohols of not less than 17 carbon atoms' such as octadecyl (meth)acrylates and behenyl (meth)acrylates; (meth)acrylates of alicyclic alcohols such as cyclo-hexyl (meth)acrylates and menthyl(meth) acrylates; (meth)acrylates of phenols such as phenyl (meth) acrylates and octylphenyl (meth)acrylates; aminoalkyl (meth)acrylates such as dimethylaminoethyl (meth)acrylates and diethylaminoethyl (meth)acrylates; (meth)acrylates possessing a polyoxyethylene chain such as polyethylene glycol mono(meth)acrylates and methoxypolyethylene glycol mono(meth)acrylates; (meth)acrylamides such as (meth) acrylamides, N-methylol (meth)acrylamides, and dimethylaminoethyl (meth)acrylamides; polyolefins such as ethylene and propylene; aromatic vinyl compounds such as styrene, alfa-methyl styrene, and t-butyl styrene; and vinyl chloride, vinyl acetate, acrylonitrile, and (meth)acrylic acids, for example. These monomers may be used either singly, or in the form of a combination of two or more monomers.

Cross-linking between polymer chains formed from the above-mentioned monomers can be achieved by including greater than 0.001% to less than 10% by weight of a cross-linkable monomer having at least two carbon—carbon double bonds which functions as a cross-linking agent. Examples of suitable cross-linkable monomers for use with category (B) monomers include ethylene glycol di(meth) acrylates, diethylene glycol di(meth)acrylates, polyethylene glycol di(meth)acrylates, polyethylene glycol polypropylene glycol di(meth)acrylates, polypropylene glycol di(meth) acrylates, 1,3-butylene glycol di(meth) acrylates, N,N-propylene bis-acrylamide, diacrylamide dimethyl ether, N,N-methylene bis-acrylamide, glycerol di(meth)acrylates, neopentyl glycerol di(meth)acrylates, 1,6-hexane diol di(meth)acrylates, trimethylol propane tri(meth)acrylates, tetramethylol propane tetra(meth)acrylates, polyfunctional (meth)acrylates obtained by the esterification of alkylene oxide adducts of polyhydric alcohols (such as, for example, glycerine, neopentyl glycol, trimethylol propane, trimethylol ethane, and tetramethylol methane) with (meth)acrylic acids, and divinyl benzene, for example. These cross-linkable monomers may be used either singly, or in the form of a combination of two or more monomers.

The properties of the resulting cross-linked polymers obtained by reacting monomers of category (B) with a suitable cross-linkable monomer (or an optional further monomer as above described) and methods for their preparation, are described more fully in EP-A-441,512, incorporated herein by reference.

Optionally, a particle of swellable material may additionally comprise at the exterior of the core, a further polymer which incorporates free hydroxyl groups, as described more completely in WO 98/28398, incorporated herein by reference. Advantageously, the attachment of the polymer incorporating free hydroxyl groups to the core is such that the polymer is not completely removed upon contact of the particle with water. Therefore, under the appropriate conditions, the water-soluble encapsulation material typically dissolves and the polymer incorporating free hydroxyl groups serves to enhance deposition onto (or retention on) skin or surfaces such as vitreous surfaces or fabric. Typically, the further polymer which incorporates free hydroxyl groups is selected from polyvinyl alcohol, cellulose, or chemically modified cellulose.

Organic polymers comprising a monomer from either category (A) or (B) may be prepared using the technique of suspension polymerisation. This is a process in which the organic monomers are formed into a suspension in an aqueous phase, and polymerised. It is customary to stabilise the suspension by incorporating a stabilising agent in the aqueous phase before adding one or more monomers. Suitable stabilising agents include polyvinyl alcohol, anionic surfactants, or non-ionic surfactants with HLB of at least 8. Alternatively, the organic polymers may be formed by emulsion polymerisation which technique produces cores of approximately less than 1 micron which can be agglomerated to a desired size. Polymerisation of each suspended droplet leads to a bead of polymer. These techniques are more fully described in WO 98/28398, herein incorporated by reference.

According to another preferred embodiment, the perfume particles in the film comprise particles comprising encapsulation material. The materials used to form the wall are typically, and preferably, those used to form microcapsules by coacervation techniques. The materials are described in detail in the patents incorporated herein before by reference, e.g., U.S. Pat. Nos. 2,800,458; 3,159,585; 3,533,958; 3,697,437; 3,888,689; 3,996,156; 3,965,033; 4,010,038; and 4,016,098.

Encapsulation Carrier Material

The preferred encapsulation material for perfumes that are to be incorporated into an aqueous low pH fabric softener composition containing cationic fabric softener is gelatin coacervated with a polyanion such as gum arabic and, preferably, cross-linked with glutaraldehyde. The preferred gelatin is Type A (acid precursor), preferably having a bloom strength of 300 or, less preferably, 275, then by increments of 25, down to the least preferred 150. A spray dried grade of gum arabic is preferred for purity. Although gelatin is always preferred, other polyanionic materials can be used in place of the gum arabic. Polyphosphates, alginates (preferably hydrolysed), carrageenan, carboxymethylcellulose, polyacrylates, silicates, pectin, Type B gelatin (at a pH where it is anionic), and mixtures thereof, can be used to replace the gum arabic, either in whole or in part, as the polyanionic material.

The gelatin/polyanion (preferably gum arabic) wall is preferably cross-linked. The preferred cross-linking material is glutaraldehyde. Other cross-linking agents such as urea/formaldehyde resins, tannin materials such as tannic acid, and mixtures thereof can be used to replace the glutaraldehyde either in whole or in part.

Another preferred encapsulation material comprises aminoplast polymers, which is an reaction product of an amine and an aldehyde, preferably an amine selected from melamine and urea and an aldehyde selected from formaldehyde, acetaldehyde and glutaraldehyde, and mixtures of said amines and said aldehydes. Particularly preferred are melamine/formaldehyde and urea/formaldehyde such as disclosed in EP-A-397245, WO0149817, WO0151197, WO0104257.

Porous Carrier Material

According to yet another preferred embodiment, the perfume particles in the film comprise particles comprising a porous carrier e.g., a silica or a zeolite such as Zeolite X, Zeolite Y, and mixtures thereof. Particularly preferred porous carriers are particles with a nominal pore size of at least about 6 Angstroms to effectively incorporate perfume into their pores. Without wishing to be limited by theory, it is believed that these particles provide a channel or cage-like structure in which the perfume molecules are trapped. Unfortunately, such perfumed particles are not sufficiently storage-stable for commercial use in granular fabric care products such as laundry detergents, particularly due to premature release of perfume upon moisture absorption.

Preferred silicas include those mentioned in EP-A-332 259, EP-A-536 942, EP-A-820 762, WO-97/08289 and WO-94/19449. Porous carrier material based on a polymeric matrix and method for the preparation of such particles include those described in EP-A-397245, EP-A-728 804, WO-94/19449, GB-2066839 and WO0209663.

One preferred porous carrier is a hydrophobic carrier particle having at least a pore volume of 0.1 ml/g consisting of pores with a diameter of 7 to 50 angstrom and having a perfume absorbed into said particle.

As used herein, hydrophobic carrier particle means a particle which passes a hydrophobicity test as hereinafter defined. The test is based on measuring the percentage of a perfume oil recovered from a perfumed carrier particle placed in salt solution. Hydrophobic particles tend not to release oil to the salt solution and typically have percentage recovery values of less than 5%. The test comprises adding 0.1 g of citral to 0.6 g of inorganic carrier with stirring until all of the perfume is absorbed. The particles are then allowed to equilibrate overnight in a sealed vial. The perfumed particles are then added to 5 ml of a 5% by weight $K_2CO_3$; solution of pH 10 stirred gently and left to stand for 5 minutes at room temperature. 5 ml of hexane are then added slowly to the surface of the salt solution and the hexane layer is stirred gently. 1 ml of the hexane is extracted and the concentration of citral in the hexane determined by UV analysis. The % recovery can then be calculated. Preferably, hydrophobic particles have percentage recovery values of less than 20%. For non-silica particles, such as alumina, it may be necessary to add 20 to 25 ml of isopropyl alcohol (IPA) per 100 ml of $K_2CO_3$; solution in order to assist with the wetting of the particles.

Suitable inorganic porous carriers for use in the present invention include aluminosilicates such as certain zeolites, clays, aluminas and silicas all with pore volume of at least 0.1 ml/g consisting of pores with a diameter between 7 and 50 angstrom which either have been thermally or chemically treated to render them hydrophobic or which by their nature are hydrophobic, such as high silica zeolites. Thermal treatment has been found to be preferred because the degree of hydrophobicity can be more easily kept to the level required for effective perfume delivery.

Preferably the porous carrier has a pore volume of at least 0.2 ml/g, most preferably between 0.1 ml/g and 1.5 ml/g consisting of pores with diameter of between 7 and 50 Å.

It was also found that when the perfumed carrier has a pore volume of at least 0.1 ml/g consisting of pores with a diameter between 7 and 50 angstrom the carrier can also function as a malodour absorber. Preferably the carrier has a pore volume of at least 0.1 ml/g consisting of pores with diameters between 20 and 40 angstrom.

The treatment can comprise heating the inorganic carrier at a temperature between 500° C. and 1000° C. for up to 3 hours. Precise temperatures and times are determined by the particular carrier used.

When a porous inorganic carrier has a pore volume of preferably 0.1 ml/g to 1.5 ml/g consisting of pores with a diameter of between 7 and 50 angstrom, the total pore volume of the carrier can be greater and include pores with a diameter greater than 50 angstrom. For example the total pore volume can be between 0.2 ml/g and 2.5 ml/g.

In the context of the present invention the porosity characteristics of a porous carrier are determined by nitrogen adsorption isotherm. The volume, Va, of nitrogen adsorbed in pores with diameters between 17 angstrom and 50 angstrom is determined according to the method of Barrett, Joyner and Halenda, "JACS", 73, 373, (1951), from the absorption data. The volume, Vb, of nitrogen absorbed in pores of between 7 angstrom and 20 angstrom in diameter is determined using T-plot analysis according to the method of Lippons and deBoer, "J Catalysis", 4, 319, (1965). Vb is calculated from the intercept at t=0 of a line fitted to the linear portion of the t-plot curve within the range , t=3 to t=16 A. If, within this range, there are two linear regions, the line with the lower gradient is used. If there are three linear regions the line is fitted to the one giving the lowest intercept at t=0. Inorganic carriers suitable for use in the present invention have a volume of Va plus Vb greater than 0.1 ml/g.

Inorganic porous carriers suitable for use in the present invention include silicas such as Gasil 200 also referred to as GASIL ex Crosfield Chemicals with a volume Va+Vb of 0.64 ml/g, an average particle size of 10–15 microns and a surface area of 730 $m^2/g$; Sorbsil ex Crosfield Chemicals with a volume Va+Vb of 0.69 ml/g, average particle size of 50–250 microns, and surface area of 730 $m^2/g$; Sorbsil C30 ex Crosfield Chem. with a volume of Va+Vb of 0.98 ml/g particle size of 60 microns, and surface area of 640 $m^2/g$ and a conventional sodium zeolite Y ex Conteka with a volume Va+Vb of 0.37 ml/g, particle size of 5 microns and surface area of 690 $m^2/g$ and MD 263 a silica as described in Example 3 of EP-A-O 287 232 with a volume Va+Vb of 0.28 ml/g, a surface area of 730 $m^2/g$ and a particle size of 25–30 microns, all of which can be treated to render them hydrophobic.

Preferred zeolites are selected from zeolite X, zeolite Y and mixtures thereof. The term "zeolite" used herein refers to a crystalline aluminosilicate material. The structural formula of a zeolite is based on the crystal unit cell, the smallest unit of structure represented by $Mm/n[(Al0_2)m(SiO_2)y].xH_2O$ where n is the valence of the cation M, x is the number of water molecules per unit cell, in and y are the total number of tetrahedra per unit cell, and y/m is 1 to 100. Most preferably, y/m is 1 to 5. The cation M can be Group IA and Group IIA elements, such as sodium, potassium, magnesium, and calcium.

A zeolite useful herein is a faujasite-type zeolite, including Type X Zeolite or Type Y Zeolite, both with a pore size typically in the range of from about 4 to about 10 Angstrom units, preferably about 8 Angstrom units.

The aluminosilicate zeolite materials useful in the practice of this invention are commercially available. Methods for producing X and Y-type zeolites are well-known and available in standard texts. Preferred synthetic crystalline aluminosilicate materials useful herein are available under the designation Type X or Type Y. For purposes of illustration and not by way of limitation, in a preferred embodiment, the crystalline aluminosilicate material is Type X and/or Type Y as described by the formulas I to VI in WO 01/40430.

In yet another embodiment, the class of zeolites known as, "Zeolite MAP" may also be employed in the present invention. Such zeolites are disclosed and described in U.S. patent application Ser. No. 08/716,147 filed Sep. 16, 1996 and entitled, "Zeolite MAP and Alcalase for Improved Fabric Care."

The perfume particles used in the present invention have an average particle size from about 0.5 microns to about 120 microns, preferably from about 2 microns to about 30 microns. However, in some cases it may be desirable to agglomerate these perfume particles using a binder or other additives to give agglomerates of suitable size e.g., 100 to 2000 microns or more preferably 100 to 300 microns which then disintegrate into the smaller perfume particles in the wash liquor.

The size of the perfume particles allows them to be entrained in surface of e.g., the fabrics with which they come in contact. Once established on the surface the particles can begin to release their incorporated perfume, especially when subjected to heat or humid conditions.

The perfume particles themselves need not be coated but in some cases additional coating may be desirable, for example to enable a slow release of the perfume after the wash. Any coating known in art may be suitable such as those described and referred to in WO 01/40430. Examples of other perfume particles suitable for use in the present invention include those described in EP-A-0859828 (glassy coating materials), WO0140430 and WO0209663 (coatings on swollen perfume carriers). The perfume particles may also be modified to enhance their deposition. For instance in fabric cleaning applications, the particles may be coated with cotton substantive polymers.

Preferably, the perfume particles of the present invention have a hygroscopicity value of less than about 80%. The "hygroscopicity value", as used herein, means the level of moisture uptake by the particles, as measured by the percent increase in weight of the particles under the following test method. The hygroscopicity value required for the present invention particles is determined by placing 2 grams of particles in an open container petri dish under conditions of 37° C. and 70% relative humidity for a period of 4 weeks. The percent increase in weight of the particles at the end of this time is the particles' hygroscopicity value as used herein. Preferred particles of the present invention have a hygroscopicity value of less than about 50%, more preferably less than about 30%. The same test can be used to test the hygroscopicity of the carbohydrate material when these are formed in the inventive perfume film chips.

Cleaning Agents

Cleaning agents may be included in the perfume film chips of the present invention. As can be appreciated for the present invention, these agents may be the same as or different from those agents which are typically used to formulate the remainder of the laundry and cleaning compositions used in combination with the perfume film chips according to the present invention. Cleaning agents include detersive surfactants (especially soaps), builders, bleaching agents, enzymes, soil release polymers, dye transfer inhibitors, fillers and mixtures thereof. The exact type of cleaning agent will of course depend on the application. The skilled person may select a different surfactant for a skin care product than for a laundry product. Cleaning agent is meant to include care or other treatment agents such fabric softening or anti-wrinkle polymers in case of a laundry application. Cleaning agents may be incorporated into the perfume particles but will preferably be in a separate particle. In one preferred embodiment, the film comprising the perfume particles further contains a fabric care agent, preferably 1–40 wt. %, more preferably 5 to 10 wt. % by weight of the total amount of solids in the film. The fabric care agent may be a cationic surfactant, a silicon compound, an anti-wrinkling agent, a fluorescer and mixtures thereof.

The amount of solids in the perfume film chips according to the invention may comprise up to 95 wt. % by weight of the final perfume film chip composition (i.e., including said solids). In one preferred embodiment, substantially all the solids in the perfume film chips are perfume particles. Usually the amount of perfume particles in the perfume film chips will be of from 0.1 to 80 wt. %, by weight of the final perfume film chip composition. Preferably, the amount of perfume particles in the perfume film chips will be at least 5 wt. % more preferably at least 10 wt. % most preferably at least 20 wt. % and preferably at most 70 wt. %, more preferably at most 60 wt. % and most preferably at most 50 wt. % by weight of the final perfume film chip composition. Preferably, more than 10 wt. % by weight of the total amount of solids in the perfume film chip are perfume particles, preferably more than 25 wt. %, more preferably more than 50 wt. %, most preferably more than 90 wt. %.

The perfume film chips preferably do not contain bleaching agents. However, when bleaching agents are included, preferably the perfume film chips contains less than 20 wt. % of a bleaching agent, preferably less than 5 wt. %, more preferably less than 1 wt. %, most preferably less than 0.1 wt. %, by weight of the total amount of solids in the film.

Although is some embodiments the perfume film chips may contain no surfactant, in other case it may be desirable that the perfume film chips contain some surfactants which can be selected from the group consisting of anionic surfactants, nonionic surfactants, cationic surfactants, zwitterionic surfactants and mixtures thereof. In those cases, the perfume film chips preferably contain less than 20 wt. % of surfactants, preferably less than 10 wt. %, more preferably less than 8 wt. % of surfactant and more than 1 wt. %, more preferably more than 2 wt. % by weight of the perfume film chip. Useful surfactants include cationic surfactants such as those marketed as HOE™ S 3996 (ex Clariant). Nonlimiting examples of surfactants useful herein include the conventional C11–C18 alkyl benzene sulfonates ("LAS") and primary, branched-chain and random C10–C20 alkyl sulfates ("AS"), the C10–C18 secondary (2,3) alkyl sulfates of the formula $CH_3(CH_2)X(CHOS0_3\text{-}M+)\ CH_3$ and $CH_3\ (CH_2)y\ (CHOS0_3\text{-}M+)\ CH—)CH_3$ where x and (y+1) are integers of at least about 7, preferably at least about 9, and M is a water-solubilising cation, especially sodium, unsaturated sulfates such as oleyl sulfate, the C10–C18 alkyl alkoxy sulfates ("AExS"; especially EO 1–7 ethoxy sulfates), C10–C18 alkyl alkoxy carboxylates (especially the EO 1–5 ethoxycarboxylates), the C10–18 glycerol ethers, the C10–C18 alkyl polyglycosides and their corresponding sulfated polyglycosides, and C12–C 18 alpha-sulfonated fatty acid esters. If desired, the conventional nonionic and amphoteric surfactants such as the C12–C18 alkyl ethoxylates ("AP) including the so-called narrow peaked alkyl ethoxylates and C6–C12 alkyl phenol alkoxylates (especially ethoxylates and mixed ethoxy/propoxy), C12–C18 betaines and sulfobetaines ("sultaines"), C10–C18 amine oxides, and the like, can also be included in the perfume film chip compositions. The C10–C18 N-alkyl polyhydroxy fatty acid amides can also be used. Typical examples include the C12–C18 N-methylglucamides. See WO-A-92/06154. Other sugar-derived surfactants include the N-alkoxy polyhydroxy fatty acid amides, such as C10–C18 N-(3-methoxypropyl) glucamide. The N-propyl through N-hexyl C12–C18 glucamides can also be used. C10–C20 conventional soaps may also be used. Mixtures of anionic and nonionic surfactants may also be especially useful. Other conventional useful surfactants are listed in standard texts.

Perfume

As used herein the term "perfume" is used to indicate any odoriferous material which is subsequently released into the aqueous bath and/or onto fabrics or other surfaces contacted therewith. The perfume will most often be liquid at ambient temperatures. A wide variety of chemicals are known for perfume uses, including materials such as aldehydes, especially C6–C14 aliphatic aldehydes, C6–C14 acyclic terpene aldehydes and mixtures thereof, ketones, alcohols and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein.

If "sun dried" odor is the preferred odor, the perfume component is selected from the group consisting Of C6–C14 aliphatic aldehydes, C6–C14 acyclic terpene aldehyde and mixtures thereof. Preferably, the perfume component is selected from C8–C12 aliphatic aldehydes, C8–C12 acyclic terpene aldehydes and mixtures thereof. Most preferably, the perfume component is selected from the group consisting of citral; neral; iso-citral; dihydro citral; citronellal; octanal; nonanal; decanal; undecanal; dodecanal; tridecanal; 2-methyl decanal; methyl nonyl acetaldehyde; 2-nonen-1-al; decanal; undecenal; undecylenic aldehyde; 2, 6 dimethyl octanal; 2, 6, 10-trimethyl-9-undece-1-nal; trimethyl undecanal; dodecenal; melonal; 2-methyl octanal; 3, 5, 5, trimethyl hexanal and mixtures thereof. The preferable mixtures are, for example, a mixture comprising 30 wt. % by weight of 2-nonen-1-al, 40 wt. % by weight of undecylenic aldehyde and 30 wt. % by weight of citral or a mixture comprising 20 wt. % by weight of methyl nonyl acetaldehyde, 25 wt. % by weight of lauric aldehyde, 35 wt. % by weight of decanal and 20 wt. % by weight of 2-nonen-1-al.

By selecting a perfume component from among the foregoing, a "sun dried odor" is produced on the fabric even though the fabric is not actually dried in the sun. The "sun dried" odor is formed by selecting aldehydes such that at least one of them is present naturally in cotton fabrics after the fabric is dried in the sun and thus, are a component of the sun dried odor.

Perfumes may also include pro-fragrances such as acetal pro-fragrances, ketal pro-fragrances, ester pro-fragrances (e.g., digeranyl succinate), hydrolyzable inorganic-organic profragrances, and mixtures thereof. These pro-fragrances may release the perfume material as a result of simple hydrolysis, or may be pH-change-triggered pro-fragrances (e.g., pH drop) or may be enzymatically releasable pro-fragrances.

Preferred perfume agents useful herein are defined as follows.

For purposes of the present invention, perfume agents are those which have the ability to be incorporated into the carrier, and hence their utility as components for delivery from the carrier through an aqueous environment. WO-A-98/41607 describes some characteristic physical parameters of perfume molecules which affect their ability to be incorporated into a carrier, such as into the pores of a zeolite.

Also preferred are perfumes carried through the laundry process and thereafter released into the air around the dried fabrics (e.g., such as the space around the fabric during storage). This requires movement of the perfume out of the zeolite pores with subsequent partitioning into the air around the fabric. Preferred perfume agents are therefore further identified on the basis of their volatility. Boiling point is used herein as a measure of volatility and preferred materials have a boiling point less than 300° C. Laundry agent perfume mixtures useful for the present invention perfume particles preferably comprise at least about 50 wt. % of deliverable agents with boiling point less than 300° C. (preferably at least about 60 wt. %; more preferably at least about 70 wt. %).

In addition, preferred perfume delivery particles herein for use in laundry detergents comprise compositions wherein at least about 80 wt. %, and more preferably at least about 90 wt. %, of the deliverable perfume agents have a weighted average ClogP value ranging from about 1.0 to 16, and more preferably from about 2.0 to about 8.0. Most preferably, the deliverable perfume agents or mixtures have a weighted average ClogP value between 3 and 4.5. While not wishing to be bound by theory, it is believed that perfume materials having the preferred ClogP values are sufficiently hydrophobic to be held inside the pores of the carrier and deposited onto fabrics during the wash, yet are able to be released from the pores at a reasonable rate from dry fabric to provide a noticeable benefit. ClogP values are obtained as follows.

Calculation of ClogP:

These perfume ingredients are characterized by their octanol/water partition coefficient P. The octanol/water partition coefficient of a perfume ingredient is the ratio between its equilibrium concentration in octanol and in water. Since the partition coefficients of most perfume ingredients are large, they are more conveniently given in the form of their logarithm to the base 10, logP.

The logP of many perfume ingredients has been reported; for example, the Pomona92 database, available from Daylight Chemical Information Systems, Inc. (Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each perfume ingredient and takes into account the numbers and types of atoms, the atom connectivity, and chemical bonding. The ClogP values, which are the most reliable and widely used estimates for this physicochemical property, can be used instead of the experimental logP values in the selection of perfume ingredients.

Deposition of Perfume onto Surfaces

The method for depositing perfume onto a surface (preferably fabrics) comprises contacting the perfume film chips comprising inclusions of perfume particles according to the invention with an aqueous solution (which may be water) whereby the perfume particles are released into the solution thereby forming a wash liquor and contacting the surface with the thus formed wash liquor comprising preferably at least about 0.1 ppm of the perfume particle. When the film is used simultaneously with a cleaning composition the aqueous solution may further comprise at least about 100 ppm of cleaning agents. Preferably, said wash liquor comprises from about 10 ppm to about 200 ppm of the perfume particle and optionally from about 500 ppm to about 20,000 ppm of the conventional cleaning agents. Conventional cleaning agents include detersive surfactants, builders, bleaching agents, enzymes, soil release polymers, dye transfer inhibitors, fillers and mixtures thereof. The cleaning agents may be added before or after said film.

The perfume film chips comprising inclusions of perfume particles are particularly useful for providing odor benefits during the laundering process and on wet and dry fabrics. The method comprises contacting fabrics with an aqueous liquor containing at least about 100 ppm of conventional detersive ingredients and sufficient amount of perfume film chips to provide at least about 1 ppm of the perfume particle such that the perfumed particles are entrained on the fabrics, storing line-dried fabrics under ambient conditions with humidity of at least 20 wt. %, drying the fabric in a conventional automatic dryer, or applying heat to fabrics which have been line-dried or machine dried at low heat (less than about 50° C. by conventional ironing means (preferably with steam or pre-wetting).

Mixing Perfume with Particles

As already stated, the particle comprises a particle carrier material and a perfume loaded into said carrier material. These two ingredients may be mixed in a number of different ways.

At laboratory scale, basic equipment used for this purpose can vary from a 10–20 g coffee grinder to a 100–500 g. food processor or even a 200–1000 g kitchen mixer. Procedure consists of placing the carrier material particles (zeolite or silica) in the equipment and pouring the perfume at the same time that mixing occurs. Mixing time is from 0.5 to 15 minutes. The loaded carrier material is then allowed to rest for a period from 0.5 to 48 hours before further processing. During the loading process when heating occurs, cool jacketing may be used as an option. At pilot plant level, suitable equipment is a mixer of the Littleford type, which is a batch type mixer with plows and chopper blades that operate at high RPM's, to continuously mix the powder or mixture of powders while liquid perfume oil is being sprayed thereon.

Incorporation of Perfume in Zeolite Carrier

When the Type X or Type Y Zeolites are used as the carrier herein, they preferably contain less than about 15 wt. % desorbable water, more preferably less than about 8 wt. % desorbable water, and most preferably less than about 5 wt. % desorbable water. Such materials may be obtained by first activating/dehydrating by heating to about 150 to 350° C., optionally with reduced pressure (from about 0.001 to about 20 Torr). After activation, the agent is slowly and thoroughly mixed with the activated zeolite and, optionally, heated to about 60° C. or up to about 2 hours to accelerate absorption equilibrium within the zeolite particles. The perfume/zeolite mixture is then cooled to room temperature and is in the form of a free-flowing powder.

The amount of perfume incorporated into the perfume particle is typically from 1 wt. % to 90 wt. %, preferably at least about 5 wt. %, more preferably at least about 8.5 wt. %, and preferably at most 80 wt. % more preferably at most 70 wt. % by weight of the loaded particle. When a porous carrier is used as particle material, the amount of perfume incorporated into the carrier is typically from 1 wt. % to 40 wt. %, preferably at least about 5 wt. %, more preferably at least about 10 wt. %, by weight of the loaded particle, given the limits on the pore volume of the porous carrier. The amount of perfume incorporated into the perfume film chip is preferably at least 0.01 wt. % more preferably at least about 5 wt. %, and preferably at most 80 wt. % more preferably at most 70 wt. % by weight of the perfume film chip.

Cleaning Compositions Comprising Film Chips

The perfume film chips comprising inclusions of perfume particles of the present invention are advantageously used in cleaning compositions. For the purpose of this invention cleaning is meant to include refreshing, care, conditioning compositions to treat a variety of surfaces such as skin, hair, kitchen, dish, and particularly fabric.

Preferred cleaning compositions are those comprising 0.001 to 95 wt. % of film chips by weight of the cleaning composition. Particularly preferred is a granular cleaning composition wherein the ratio of the volume mean D(4,3) diameter of the granules and the average size of the perfume chips is between 3:1 and 1:3, more preferably between 2:1 and 1:2. In another preferred embodiment the perfume films chips are used in liquid cleaning compositions wherein liquid includes gel and paste like compositions. Preferred liquid cleaning compositions are those wherein the ratio of the average density of the liquid cleaning composition—excluding the perfume chips—and the average density of the perfume chips is between 3:1 and 1:3, more preferably between 2:1 and 1:2. In another preferred embodiment the cleaning composition is packaged as a unit dose, as known in the art.

The invention is more fully illustrated by the following non-limiting example showing a referred embodiment of the invention.

EXAMPLE

The following is a representative example suitable for use in the present invention. 25 g of Maltodextrin (Dextrose Equivalent=13–17 from Aldrich) were added to 15 g of water and the mixture was heated and stirred to get a transparent isotropic but viscous solution. To this solution was added 2 g of a 40 wt. % solution of Cationic surfactant HOE S 3996 (Clariant) and the mixture was stirred. To this mixture was added 10 g perfumed silica (perfume: silica=1:10) and the mixture was stirred vigorously with a spoon to obtain a viscous slurry.

The perfumed silica was obtained by mixing thoroughly with a glass rod one part of perfume and 10 parts of silica in a beaker. This slurry was cast onto a glass plate to a thickness of 1000 micron and left in an oven at 70° C. for 1 h followed by overnight drying under ambient conditions. After drying, chips of maltodextrin-encapsulated silica-perfume were obtained by scraping the glass plate. These chips were ground in a mixer (Moulinette™ ex Moulinex™) to obtain a size of ca. 700 microns.

The invention claimed is:

1. A process for preparing perfume film chips comprising inclusions of perfume particles wherein process comprises the steps of a) forming a film of water reactive material containing inclusions of perfume particles;

b) solidifying said film by cooling and/or drying and c) comminuting the solidified film into perfume film chips comprising inclusions of perfume particles wherein said particles comprise particle carrier material and perfume loaded into said carrier material.

2. A process according to claim 1 wherein, the film containing inclusions of perfume particles is solidified to an average film thickness of less than 4 mm.

3. A process according to claim 1 whereby after communition step c) the diameter of the inclusions is less than the diameter of the perfume film chip.

4. A process according to claim 1 whereby the perfume film chip comprises, in addition to the inclusions of perfume particles, more than 5% (vol/vol) of gas-inclusions by volume of the perfume film chip.

5. A process according to claim 1 whereby the film is formed by aqueous casting on a rotating drum or a moving belt in step a).

6. A process according to claim 1 whereby the film comprising inclusions of perfume particles has a brittleness degree of less than 100%.

7. A process according to claim 1 whereby the amount of perfume particles in the perfume film chips is from 0.1 to 80 wt. % by weight of the final perfume film chip composition.

8. A process according to claim 1 wherein the perfume film chips comprise from about 1 wt. % to about 95 wt. % of the water reactive material by weight of the total perfume chip composition.

9. A process according to claim 1 wherein said water reactive material of said film comprises polymers, copolymers or derivatives thereof selected from polyvinyl alcohols, polyvinyl pyrrolidone, polyalkylene oxides, cellulose, cellulose ethers, polyvinyl acetates and acetals, polycarboxylic acids and salts, proteins, polyamides, polyacrylates, polymethacrylates, polysaccharides, resins, gums, carbohydrate material and mixtures thereof.

10. A process according to claim 1 whereby the perfume particle carrier material is selected from encapsulation, swellable carrier material and mixtures thereof.

11. A process according to claim 1 wherein the perfume film chip comprises 0 to 70 wt. % of a dye or a pigment by weight of the final perfume film chip composition.

12. A method of improving the storage stability of perfume particles comprising the steps of a) forming a film of water reactive material containing inclusions of perfume particles;

b) solidfying said film by cooling and/or drying and c) comminuting the solidified film into perfume film chips comprising inclusions of perfume particles wherein said particles comprise particle carrier material and perfume loaded into said carrier material.

* * * * *